United States Patent [19]

Etchell

[11] Patent Number: 4,782,752

[45] Date of Patent: Nov. 8, 1988

[54] CONTROL DEVICE FOR CIRCUMFERENTIAL AND LATERAL ADJUSTMENT OF PRINTING CYLINDER

[75] Inventor: Gordon Etchell, Downers Grove, Ill.

[73] Assignee: Pathfinder Graphic Associates Inc., Justice, Ill.

[21] Appl. No.: 64,865

[22] Filed: Jun. 22, 1987

[51] Int. Cl.[4] ..... B41F 13/14

[52] U.S. Cl. ..... 101/248

[58] Field of Search ..... 101/248, 181, 247

[56] References Cited

U.S. PATENT DOCUMENTS

| | | | |
|---|---|---|---|
| 2,234,674 | 3/1941 | Jacobson | 101/248 X |
| 3,505,953 | 4/1970 | Germann | 101/248 |
| 4,137,845 | 2/1979 | Jeschke | 101/248 |

*Primary Examiner*—J. Reed Fisher

[57] ABSTRACT

A control device for circumferentially adjusting a plate cylinder of a printing press which is driven by a helical drive gear which drives a cooperating driven helical gear. The driven helical gear is rotatively coupled to one journal of the plate cylinder but is attached by lateral splines which permit lateral movement of the driven gear with respect to the journal and vice versa. Adjustment means are provided for laterally moving the driven helical gear with respect to the helical drive gear some distance either way from a coplaner relationship, thus changing the phase of the plate cylinder. Lateral adjustment of the plate cylinder is achieved by laterally adjusting the other journal of the plate cylinder during which adjustment the first journal moves laterally with respect to the driven gear due to the lateral spline attachment and does not effect the circumferential adjustment.

9 Claims, 2 Drawing Sheets

CONTROL DEVICE FOR CIRCUMFERENTIAL AND LATERAL ADJUSTMENT OF PRINTING CYLINDER

BACKGROUND OF THE INVENTION

This invention relates to printing presses generally of the offset printing type. Such presses consist of plate cylinders rotatably mounted on a press frame. In connection with the operation of such a press, it is important to be able to circumferentially and laterally adjust the plate cylinder so that it is in sync with adjacent rotating cylinders.

SUMMARY OF THE INVENTION

The present invention provides a novel means for effecting independent circumferential and lateral adjustment of a plate cylinder. This is achieved by effecting relative displacement of a helical drive gear and a helical driven gear. Although circumferential adjustment by such displacement is well known in the art, the specific means used to achieve such adjustment, according to the present invention, result in the use of a minimum number of parts and do not require resilient members or spring members as are present in some of the prior art.

Moreover, the circumferential adjusting means of the present inventions results in an arrangement located entirely on the operating side of the printing press in a compact arrangement which can be easily enclosed in the oil bath for the operating gears, thus keeping the elements of the circumferential adjustment free from outside contaminants.

Important elements of the present invention include mounting the helical driven gear to the plate cylinder journal in a rotatively coupled but laterally slidable manner. In addition, the bearing assembly in which the journal rotates is secured to the side frame of the printing press by a single retainer plate which both prohibits circumferential movement of the bearing assembly and limits lateral motion to ensure that the driven gear and drive gear are always in mesh.

An object of the present invention is to provide means for such circumferential and lateral adjustment whereby neither adjustment means effects the setting of the other means.

It is a further object to provide a simplified device for achieving circumferential adjustment which device can be compactly located within the housing for the oil bath and thus not be exposed to outside contaminants.

BRIEF DESCRIPTION OF THE DRAWINGS

The present invention and method of operation will be better understood from the following detailed description when read in connection with the accompanying drawings in which.

SPECIFICATION

Figure 1:
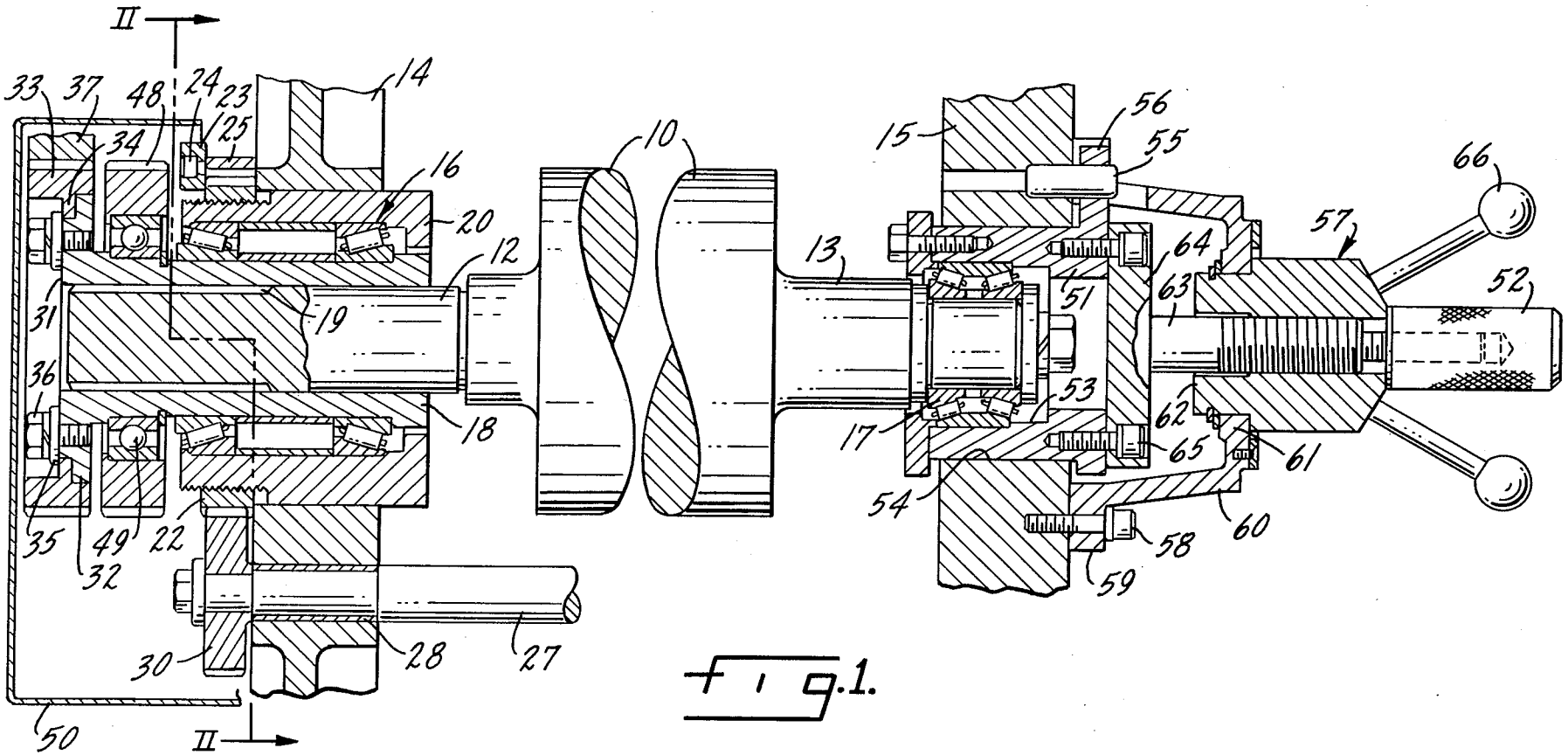
FIG. 1 is a fragmentary longitudinal sectional view of the circumferential and lateral adjustment device of the present invention.

As shown in FIG. 1, plate cylinder 10 is mounted to journals 12, 13 which in turn are rotably mounted to the side frames 14, 15 of a printing press by means of bearing assemblies 16, 17 respectively, as will be described with more particularity later herein.

Figure 2:
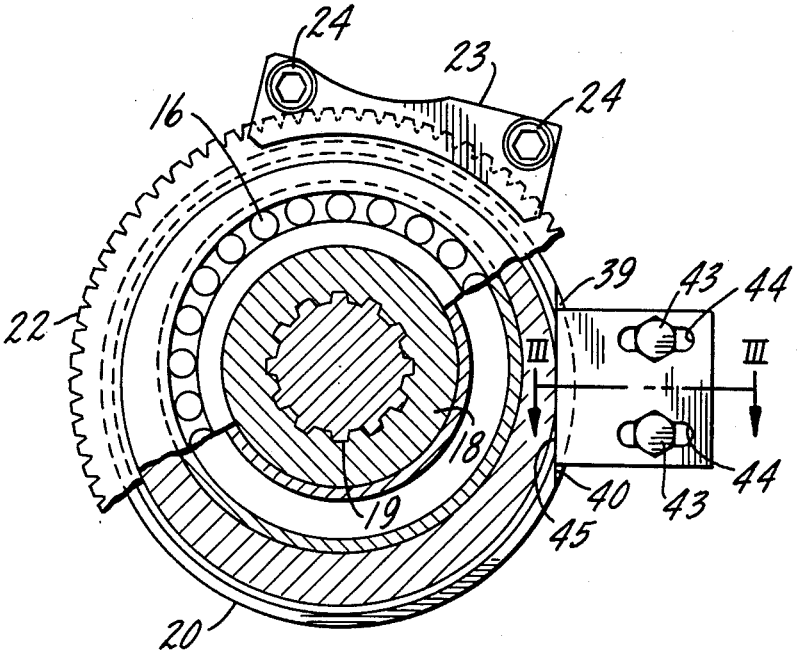
FIG. 2 is a view along the lines II—II of FIG. 1.

The circumferential adjustment mechanism is shown at the drive side (left side) of FIG. 1. Journal 12 is secured to the inner sleeve 18 of bearing assembly 16 to permit relative lateral movement but not relative rotationaly movement of the inner sleeve and journal. This is accomplished by journal 12 being splined to inner sleeve 18 by means of lateral splines 19 as shown in FIG. 2.

Inner sleeve 18 and, therefore journal 12, may rotate freely in bearing assembly 16.

Outer sleeve 20 of bearing assembly 16 is threadably secured to circumferential adjustment gear 22 which is prevented from lateral movement with respect to side frame 14 by means of gear retaining plate 23 which is secured to the side frame 14 by means of bolts 24 and spacers 25. It is preferable to use two such retaining plates at opposite ends or to use one retaining plate which extends around the entire circumference. Accordingly, adjustably rotating the circumferential adjustment gear 22 will result in lateral movement of bearing assembly 16. Rotation of circumferential adjustment gear 22 is achieved by manually rotating circumferential adjustment hand wheel (not shown) which is mounted on shaft 27 which is rotably secured to side frames 14, 15 by means of bushings 28. This, in turn rotates gear 30 which cooperates with circumferential adjustment gear 22 in meshed relation.

Inner sleeve 18 includes a gear hub 31 at its left-most end having flange 32. Helical gear 33 which is driven by fixed helical drive gear 37 is secured to gear hub 31 by means of flange 34 which seats against flange 32. This is preferably accomplished by frictional engagement such as by friction washers 35 and machine bolts 36. The frictional attachment is a safety feature which permits frictional slippage of the helical gear 33 with respect to the gear hub 31 in case the drive train, including helical drive gear 37, is suddenly halted, thus preventing damage to gear teeth.

Figure 3:
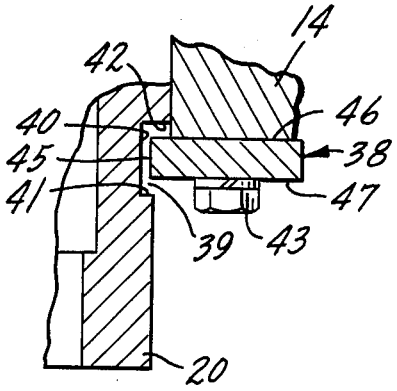
FIG. 3 is a detail sectional view along the lines III—III of FIG. 2.

An important feature of the present invention is providing a single means for preventing rotational movement of outer sleeve 20 relative to side frame 14 and for limiting lateral movement of outer sleeve 20 so that helical gears 33 37 always remain in meshed engagement. This is accomplished by means of a sleeve retainer plate 38 and open channel 39 on outer sleeve 20. As shown in FIG. 3, outer sleeve 20 includes an open channel 39 which includes a flat inner surface 40 and, orientated vertically thereto, abutment surfaces 41, 42. The sleeve retainer plate 38, which includes one generally flat surface 45, is secured to the side frame 14 by means of bolts 43. The retainer plate is provided with slots 44, through which bolts 43 pass, to permit slidable adjustment of the retaining plate to ensure abutment of flat surfaces 40, 45 before the plate is finally secured. As shown in FIG. 3, surfaces 40, 45 are just shy of abutment. This arrangement prohibits any rotational motion of outer sleeve 20 relative to side frame 14.

Lateral movement of outer sleeve 20 is restricted by abutment surfaces 41, 42 and the top and bottom surfaces 46, 47 of retainer plate 38. Rotating the circumferential adjustment hand wheel in one direction will eventually cause the top surface 46 of retainer plate 38 to abut against abutment surface 42, and turning the hand wheel in the other direction will eventually cause the bottom surface 47 to abut against abutment surface 41. Abutment surfaces 41, 42 are spaced apart a distance-less than the thickness of helical drive gear 37 to insure that helical gears 37, 33 always remain in meshed engagement.

Circumferential adjustment is achieved by manually rotating the circumferential adjustment hand wheel. This causes rotation of circumferential adjustment gear 22 which causes lateral movement of outer sleeve 20 to which it is threadably secured. This causes the bearing assembly 16, its inner sleeve 18, and thus helical gear 33, to move laterally. The attendant relative movement of helical gear 33 with respect to helical drive gear 37 results in a phase change of rotation of journal 12 and hence plate cylinder 10, thus achieving circumferential adjustment. However, there is no lateral movement of journal 12 and plate cylinder 10 during this operation since the lateral splines 19 permit the inner sleeve 18 to move laterally with respect to journal 12.

A free rotating auxiliary gear 48 may also be secured to inner sleeve 18 by any suitable means, such as bearing assembly 49. This auxiliary gear may be used to operate other devices such as a water oscillator (not shown).

It is preferable to use a bearing to mount free rotating auxiliary gear 48 so that during circumferential adjustment when helical driven gear changes speed, the auxiliary gear remains at a constant speed.

In any event, the resultant compact arrangement allows enclosure of all moving parts in the housing 50 for the gear box oil bath keeping these parts free from outside contamination.

Lateral adjustment is achieved in a standard known manner. Journal 13 is rotably secured at the operating side (right side) to side frame 15 by bearing assembly 17 which is secured in circumferential channel 53 of bearing seat assembly 51. Bearing seat assembly 51 fits in an aperture 54 in side wall 15 by a close but not press fit. The contacting surfaces at this fit are lubricated to permit movement of bearing seat assembly 51 relative to side frame 15. However, rotational movement is prevented by dowel 55 fixed to side frame 15 and slidably secured to flange 56 on bearing seat assembly 51.

Lateral hand wheel adjustment assembly 57 is secured to side frame 15 by bolts 58 passing through an opening in the flanges 59 of legs 60. The legs 60 terminate in a circumferential hub seat 61 to which hub 62 is rotably mounted. The hub 62 is threadably secured to shaft 63 which has an end plate 64 bolted to bearing seat assembly 51 by bolts 65. Manual rotation of the lateral adjustment hand wheel 66 causes lateral movement of shaft 63 and thus lateral movement of bearing assembly 17 and journal 13. Since journal 12 is laterally splined to inner sleeve 18, this lateral adjustment does not effect the circumferential adjustment previously described. A known type of manual locking mechanism 52 may also be provided to lock in the lateral adjustment.

Although the invention is described and illustrated with reference to a preferred embodiment as detailed herein, it should be understood that this in no way limits the disclosure which is capable of numerous modifications which are within the scope of the following claims.

I claim:

1. In a rotating printing press having a support frame, a helical drive gear and a mating driven helical gear, a rotating plate cylinder having a drive side journal fixed on one end and an operating side journal fixed on the opposite end, a device for adjusting the circumferential and lateral displacement of the plate cylinder comprising:

(a) drive side bearing means mounted to said support frame for rotatably supporting the drive side journal;

(b) said drive side bearing means including a cylindrical inner sleeve;

(c) single retaining means for prohibiting circumferential movement and limiting lateral movement of said drive side bearing means;

(d) said cylindrical inner sleeve rotatably coupled but slidably laterally coupled to the drive side journal and rotatably coupled to the driven helical gear;

(e) circumferential adjustment means for laterally moving said drive side bearing means within the lateral limits defined by said single retaining means;

(f) means for operating said circumferential adjustment means;

(g) means for mounting said operating side journal rotatably but slidably mounted to the support frame;

(h) independent adjusting means independent of said circumferential adjusting means for laterally adjusting the position of said operating side journal;

(i) whereby said drive side journal slides laterally, during such lateral adjustment, with respect to said driven helical gear and does not effect the relative positions of said helical drive gear and said helical driven gear.

2. A device for adjusting the lateral and circumferential displacement of a plate cylinder as defined in claim 1 further comprising an oil bath enclosure mounted on said support frame at the drive side bearing means for enclosing the drive side bearing means, helical drive gear, driven helical gear, and said circumferential adjustment means in an oil bath environment.

3. A device for adjusting the lateral and circumferential displacement of a plate cylinder as defined in claim 1 wherein said circumferential adjustment means comprises a gear threadably secured to said drive side bearing means and further comprising retaining means operative on said gear for keeping said gear in a fixed lateral position with regard to said support frame.

4. A device for adjusting the lateral and circumferential displacement of a plate cylinder as defined in claim 2 wherein said circumferential adjustment means comprises a gear threadably secured to said drive side bearing means and further comprising retaining means operative on said gear for keeping sad gear in a fixed lateral position with regard to said support frame.

5. A device for adjusting lateral and circumferential displacement of a plate cylinder as defined in claim 1 wherein said drive side bearing means includes an outer generally cylindrical sleeve- which is received in a generally cylindrical aperture in said support frame, an open channel in said outer sleeve having a flat surface forming a cord with regard to said outer sleeve and having two normal surfaces depending from said flat surface defining said channel, a retainer plate having one generally flat edge, said retainer plate mounted to said frame for slidable engagement of said generally flat edge with the flat surface of said open channel, the thickness of said retainer plate being less than the opening in said channel by an amount less than the thickness of the helical drive gear.

6. A device for adjusting lateral and circumferential displacement of a plate cylinder as defined in claim 2 wherein said drive side bearing means includes an outer generally cylindrical sleeve which is received in a generally cylindrical aperture in said support frame an open channel in said outer sleeve having a flat surface forming a cord with regard to said outer sleeve and having two normal surfaces depending from said flat surface defining said channel, a retainer plate having one generally flat edge, said retainer plate mounted to said frame for slidable engagement of said generally flat edge with the flat surface of said open channel, the thickness of said retainer plate being less than the opening in said channel by an amount less than the thickness of the helical drive gear.

7. A device for adjusting lateral and circumferential displacement of a plate cylinder as defined in claim 1 further comprising an auxiliary gear rotatably mounted to aid said inner sleeve.

8. A device for adjusting lateral and circumferential displacement of a plate cylinder as defined in claim 2 further comprising an auxiliary gear rotatably mounted to aid said inner sleeve.

9. A device for adjusting lateral and circumferential displacement of a plate cylinder as defined in claim 1 wherein said single retaining means both prohibits circumferential movement and limits lateral movement of said drive side bearing means.

* * * * *